US005267651A

United States Patent [19]

Hughes

[11] Patent Number: 5,267,651

[45] Date of Patent: Dec. 7, 1993

[54] SUPPORT POST FOR PACKAGING SYSTEM

[76] Inventor: Billy R. Hughes, 1300 Fox Hollow Dr., Hartsville, S.C. 29550

[21] Appl. No.: 868,817

[22] Filed: Apr. 15, 1992

[51] Int. Cl.[5] ..... B65D 81/02

[52] U.S. Cl. ..... 206/586; 206/453

[58] Field of Search ..... 206/586, 591, 592, 594, 206/453, 320; 229/DIG. 1

[56] References Cited

U.S. PATENT DOCUMENTS

| | | | |
|---|---|---|---|
| 1,821,692 | 9/1931 | Copeland . | |
| 3,072,313 | 1/1963 | Svendsen . | |
| 3,086,689 | 4/1963 | Wiedenmeier | 206/586 X |
| 3,119,542 | 1/1964 | Pomerantz | 206/594 X |
| 3,129,868 | 4/1964 | Jenk . | |
| 3,244,347 | 4/1966 | Jenk . | |
| 3,262,598 | 7/1966 | Carder et al. . | |
| 3,362,609 | 1/1968 | Freedy | 206/453 X |
| 3,433,354 | 3/1969 | Liebel . | |
| 3,536,245 | 10/1970 | Palmer . | |
| 3,648,920 | 3/1972 | Stump . | |
| 3,708,101 | 1/1973 | McDanield . | |
| 3,734,389 | 5/1973 | Brown . | |
| 3,901,995 | 8/1975 | Conlon . | |
| 3,935,357 | 1/1975 | Padovani . | |
| 3,982,682 | 9/1976 | Fremion . | |
| 4,120,441 | 10/1978 | Hurley . | |
| 4,202,449 | 5/1980 | Bendt . | |
| 4,244,471 | 1/1981 | Plante . | |
| 4,482,054 | 11/1984 | Gardner . | |
| 4,483,444 | 11/1984 | Gardner . | |
| 4,925,512 | 5/1990 | Briand . | |
| 4,951,821 | 8/1990 | Kempkes | 206/453 |

*Primary Examiner*—Bryon P. Gehman

[57] ABSTRACT

A support post for appliance packaging defined from a formed paperboard tube and including inner and outer walls with laterally directed stiffening beads formed from either wall and extending into free engagement with the opposite wall. The stiffening beads include opposed side panels with an integral apex portion therebetween. At least one side panel extends at an acute interior angle to the side from which the bead is formed for a generally lateral inclination of the bead to lie at least partially between planar portions of the inner and outer wall to form intermediate layers upon collapse of the inner and outer walls toward each other.

18 Claims, 2 Drawing Sheets

FIG. 1
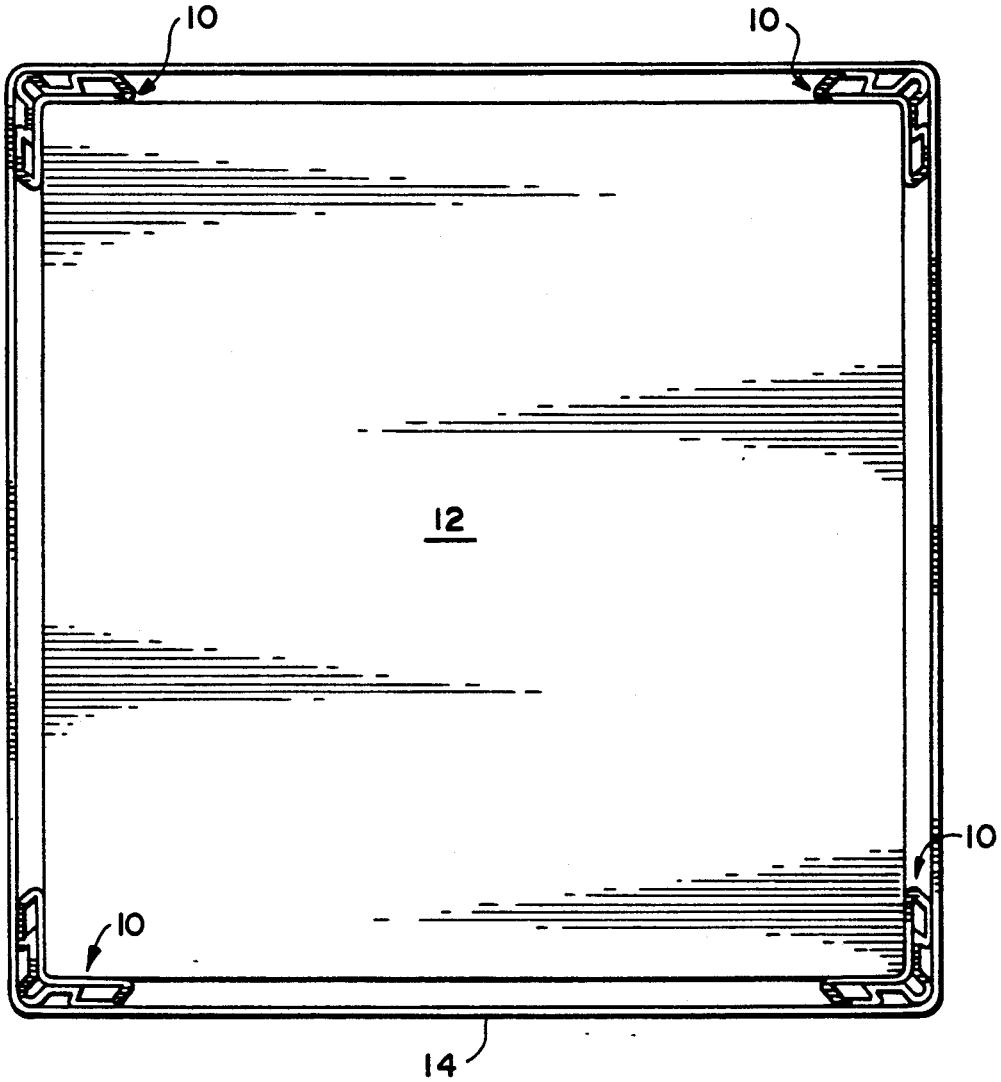
FIG. 6
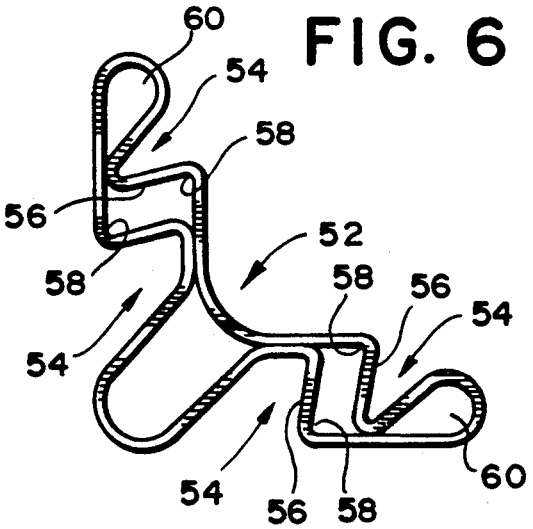
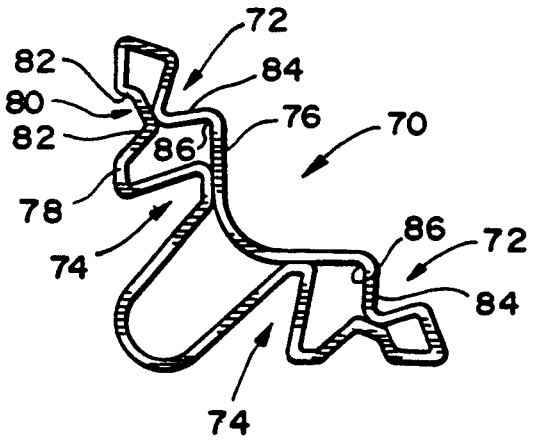
FIG. 7

SUPPORT POST FOR PACKAGING SYSTEM

BACKGROUND OF THE INVENTION

In the packaging of heavy products, for example home appliances including washers, dryers, refrigerators, and the like, a preferred procedure involves the use of spaced support posts extending between a bottom appliance supporting platform and a top cap with a surrounding protective sleeve of corrugated cardboard or plastic wrap.

Such support posts are normally formed of paperboard and adhesive, or other material, convolutely wound into a tubular configuration and transversely formed to the desired post configuration. Such tube formed support posts are considered particularly desirable in light of the substantial strength achieved and the economies derived from both using an inexpensive basic material and the simplified manufacturing procedures involved, requiring only the controlled deformation of a conventionally formed convolute tube prior to a final curing of the resins or adhesives between the plies.

Support posts formed in the above manner ideally have high stacking strength and an ability to provide for a lateral protecting and cushioning of the product. However, the structural integrity of the conventional posts when subjected to excess loading in the cross section direction has been packaged products are frequently subjected to transverse forces resulting from handling equipment or contact with adjacent items, which forces are normally accommodated by transverse strength of the posts. Should this transverse loading become excessive, the conventional post will be compressed in a manner which both greatly affects the vertical compressive strength of the post and gives rise to the potential for damage to the product itself.

The conventional post, as for example noted in U.S. Pat. Nos. 4,482,054, issued Nov. 13, 1984, and 4,483,444, issued Nov. 20, 1984, comprises a pair of spaced walls with one or more full length lateral indentations or beads extending transversely between the walls. These indentations include diverging sides, so configured as to inherently open and flatten relative to each other upon the subjecting of the post to a transverse compressive load with the post under extreme compression. The post ultimately assumes, at the area of compression, a flat cross section consisting of only two layers defined by the outer and inner walls. Such a flattening of the support post will not only affect the longitudinal compressive strength of the post in an obvious manner, but will also substantially eliminate any cushioning property of the post and expose the packaged product to direct damage by the handling equipment and/or by dynamic impact loading.

With regard to product damage, appliances and the like are strongest at the vertical corners thereof, and normally relatively weak and susceptible to impact damage to the paneling thereon inward of the corners. Thus, a support post flattened to a basic two layers as above described will not only have little or no cushioning properties, but will also tend to transfer any compressive forces to the vertical edge of the compressed post and to the relatively weaker area of the product remote from the corner.

SUMMARY OF THE INVENTION

The present invention involves an improved support and cushioning post, preferably formed of a convolutely wound paperboard tube, configured to provide, in addition to longitudinal and transverse compressive strength and transverse cushioning, a controlled transverse collapsing when subject to excess external loads which directs the transverse loading to the area of maximum strength of the product, and which maintains a substantial portion of the longitudinal compressive strength of the post.

As opposed to the conventional support post wherein a transverse collapsing thereof produces a complete flattening of the tube in the area of the compressive force resulting in two planar overlying layers across the width of the post, the post of the present invention provides, even in an area of complete transverse compression, a multi layer configuration of at least four layers at the area of maximum strength of the packaged product itself. The four layers, and the stability obtained by the bulk thereof, retain both a substantial portion of the longitudinal compressive strength of the post and an ability to continue to cushion the product by directing the forces to areas that will better withstand the compression.

Structurally, the support post, formed with a generally right-angle cross section to accommodate the vertical corner area of a product to be packaged, includes inner and outer walls, at least one of which is inwardly folded to define a bead, indentation, angle or concave portion engaging a corresponding portion of the other wall. The bead, including the sides or side panels thereof, extends at an inclined angle, that is other than perpendicular, to the inner and outer walls. So configured, and with at least one of the bead side panels at an acute included or interior angle to the wall from which it is formed, a collapsing or crushing of the post thereat will cause the bead to fold on itself between the walls and define a pair of intermediate layers between the outer and inner walls of the post. The orientation of the bead across the width of the post determines the position of the multiple layers. Thus, by positioning the bead adjacent the corner of the post, or in close proximity thereto, the compacted multiple layers will be similarly positioned for continued engagement with the strengthened corners of the product itself which are best able to accommodate lateral compressive forces.

Varying the specific angle of the fold over bead enables the formation of posts with differing transverse strengths prior to a collapsible compression of the posts. This in turn allows for variations in the cushioning properties of the post while maintaining basically the same longitudinal compressive strength. The controlled nature of the collapse of the posts under excess transverse loading, and the resultant multi layering in a predetermined area contemplated to maximize product support and post stability, also enables construction of the posts using less material, that is having thinner walls. Other features of the invention, and advantages derived therefrom will become apparent from the more detailed description following hereinafter.

BRIEF DESCRIPTION OF THE DRAWINGS

FIG. 1 is a top plan view of a product package, with the top cap removed, illustrating positioning of the support and cushioning posts of the invention.

FIG. 6 is a an end view of another form of post incorporating the features of the invention; and FIG. 7 illustrates a further form of post.

DESCRIPTION OF PREFERRED EMBODIMENTS

Figure 2:
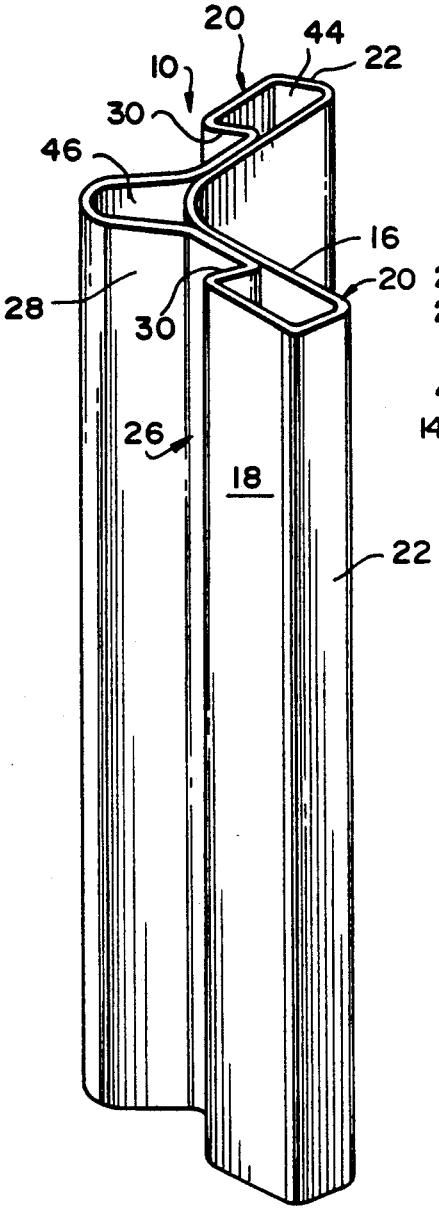
FIG. 2 is an enlarged perspective view of the support post.

FIG. 1 illustrates the hollow support post 10 in its in use environment stabilizing a product 12, for example a heavy kitchen appliance, within a packaging sleeve 14. The packaging sleeve 14 in turn stabilizes and positions the support posts 10 in confining and cushioning engagement with the product 12 with the support posts normally extending between a lower support platform and a top cap (not illustrated).

The support posts 10 are principally used at the corners of the product, and as such, are of a basic right angular configuration as illustrated.

The support posts 10, preferably formed from a convolutely wound paperboard tube formed to the desired cross-sectional configuration, provide both a longitudinal compressive strength for stacking purposes and a capability to cushion and accommodate lateral compressive forces. Most significantly, the post maintains both linear and lateral force-accommodating capabilities even under conditions of maximum lateral compression.

More particularly, the post 10 includes inner and outer walls 16 and 18 in generally parallel spaced relation to each other and defining a pair of duplicate post sections 20 at approximately right angles to each other to form a corner post. The inner and outer walls 16 and 18 are integrally joined by end walls 22.

A full length indentation or bead 26 is formed from said outer wall 18 longitudinally along each post section 20, and extends inwardly to the inner wall 16 at an angle to a perpendicular line from said outer wall. The bead includes opposed sides or side panels 28 and 30 integrally joined at the apex portion 32 of the bead which is in non-adhered contact with the inner surface of the inner wall 16. Thus configured, the beads 26 define means for stiffening the post 10 and for providing a cushioning capability thereto against lateral load.

Figure 4:
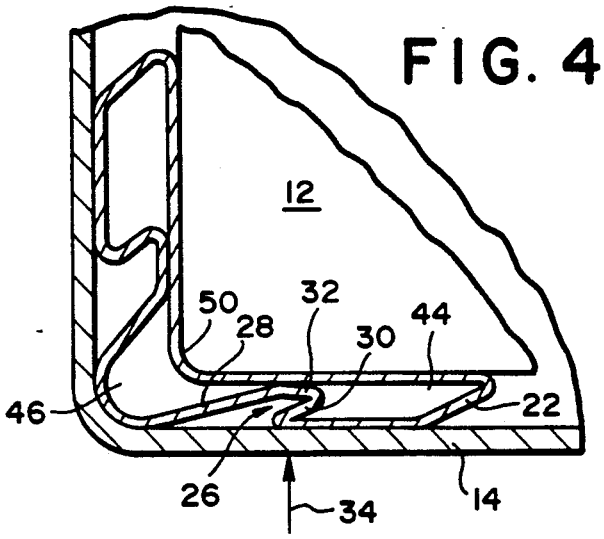
FIG. 4 illustrates a partial collapse of the support post.
Figure 5:
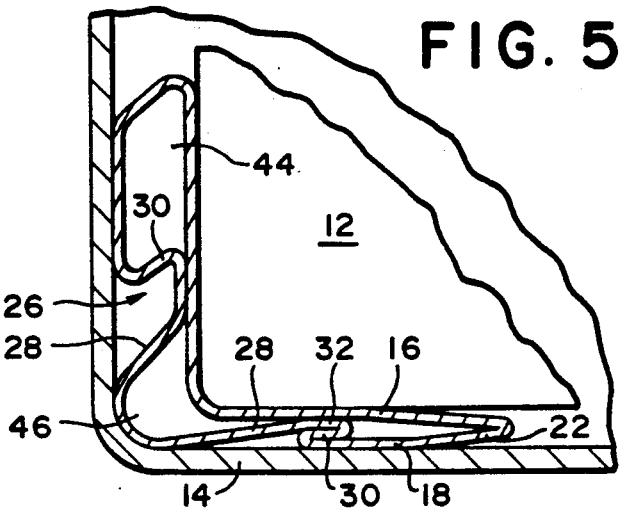
FIG. 5 illustrates a support post at its maximum compression.

In distinguishing from the conventional post, the bead 26 is so configured and directed as to collapse, under excess loading, laterally and into general overlying relation with itself in the space between the inner and outer walls so as to define, as sequentially illustrated in FIGS. 4 and 5, a layered construction of at least four layers which provides substantial lateral thickness and a corresponding strength derived therefrom.

Arrow 34 in FIG. 4 illustrates the normal direction of a lateral squeezing or impact load to which the package will be subjected. In order to ensure a proper collapsing of the bead 26, at least one side panel 30 thereof is reversely directed at an included acute angle 36, that is an angle of less than 90 degrees, with the panel 30 positioned to lie between portions of the inner and outer walls. Thus, upon a subjecting of the post section 20 to a lateral compressive force sufficient to deform or fold the bead 26, the side panel 30 will fold downwardly toward the included angle 36. A similarly directed sliding movement of the apex portion 32 of the bead will ultimately define a pair of intermediate layers, consisting of side panel 30 and apex portion 32, between the layers formed by the inner and outer walls 16 and 18, all as will be appreciated from FIGS. 4 and 5. Depending upon the width of the apex portion 32, the angle of side panel 28, and the spacing between panels 28 and 30, the intermediate layers may be formed by a direct overlying of the panels 28 and 30.

Figure 3:
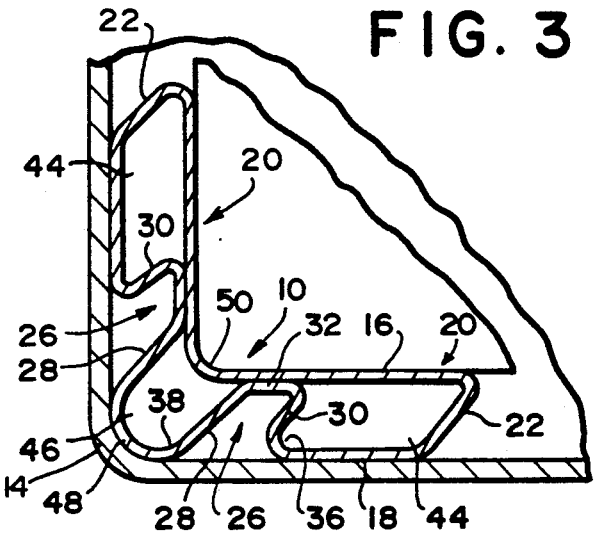
FIG. 3 is a cross-sectional detail illustrating the positioning of the support post within a package.

As illustrated in FIG. 3, the second side panel 28 of each bead 26 may be angled in generally the same direction as the side panel 30, extending at an obtuse included angle 38. So directed, there is a tendency to encourage the desired side folding of the bead 26. Each end wall 22 of the post 10 is similarly angled whereby upon a collapsing of the corresponding portions of the inner and outer walls 16 and 18 toward each other, there will be a tendency for the outer wall 18 to laterally shift toward the corner and encourage the internal folding of the bead 26.

It is particularly desirable that the bead 26 fold immediately adjacent the corner defined by the post 10 as this corresponds to the vertical corner of the product or appliance 12 which in turn is the area of greatest strength and best able to direct and accommodate any continued compressive forces which might be introduced thereto, in the general direction of arrow 34, without damage to the outer paneling of the appliance which is normally unsupported away from the actual corners thereof.

While the strength of the post and its cushioning ability can obviously be a function of the actual number of paperboard plies used to define the basic tube, the configuration of the post of the invention also lends itself to the accommodation of multiple different conditions. In particular, through a variation in the angle of the bead, as well as the relationship between the sides thereof both to the inner and outer walls and to each other, provision can be made for the accommodation of lesser or greater cross-sectional loading prior to the actual folding over or collapsing of the bead. This allows for a wide range of cushioning properties which might be required by the particular products, provided in conjunction with a longitudinally rigid post.

Referring again to FIG. 3, the formed post 10 includes relatively wide outer bulbous portions 44 of generally rectangular parallelopiped configuration wherein the inner and outer walls include planar widths respectively engaged with the product and packaging sleeve. The post also includes a bulbous central section 46, defined by the opposed side panels 28 of the similar beads 26 in the respective post sections 20 and wherein the outer wall 18 forms an arcuate corner 48 about which the packaging sleeve 14 is received, and wherein the inner wall forms a corner 50 receiving the corner of the product 12. These bulbous portions are defined by the depth of the beads 26 and form the portions of the inner and outer walls which respectively engage the packaged product and the packaging sleeve. As described, the bulbous portions 44 receive the collapsed or collapsing beads 26 therein an flexing of the corner bulbous portion 46 accommodates the shifting movement of the beads while maintaining product and sleeve contact.

It is to be particularly appreciated that the bead 26 performs not only the desired basic functions of transversely stiffening and strengthening the post through a direct surface to surface engagement with the post wall opposed from the post wall from which the bead is defined, and which at the same time provides a positive cushioning effect, but also, and significantly, and uniquely to the present invention, provides for a retention of substantial post strength even under conditions of complete bead collapsible. This is achieved, as above described, by the formation of a post cross section incorporating multiple layers intermediate the basic inner and outer wall layers. This distinctly and significantly differs from the conventional tube formed post wherein collapse thereof provides only two overlying layers, no intermediate strengthening layers and no directing of compressive forces.

Posts constructed in accord with the present invention, and in particular incorporating beads formed for overlapping multi layer collapsing in a predictable and desirable manner as described, can assume a variety of shapes in accord with the products to be accommodated, the cushioning effect desired, and the like. Noting FIG. 6, each right angle section of the post 52 therein has the stiffening and cushioning beads 54 defined both in the inner wall and the outer wall, the beads in each case being in free sliding engagement with the inner surface of the opposed wall. Each bead includes at least one side panel 56 which is reversely angled to define an included acute angle 58 to guide and insure an inward collapsing of the beads to define overlying intermediate layers between the inner and outer walls of the post.

In the embodiment of FIG. 6, the bead defined from the inner wall in each post section is positioned laterally outward of the bead defined in the outer wall with the inwardly foldable bead side panels 56 in relatively closely spaced generally parallel relation to each other. Depending upon the spacing between these adjacent panels 56, the corresponding beads 54 may actually fold upon each other, providing in effect as much as six layers of material. It will also be noted that the narrow defined apex of each inner wall bead 54 will result in the sides of this bead directly engaging on each other in a multiple intermediate layer upon collapse of the bead.

The bulbous outer portions 60 at the longitudinal side extremities of the post sections accommodate movement of the beads both during the cushioning action thereof and as the beads collapse under excess pressure. These bulbous portions 60, while engaging the packaging sleeve, are spaced from the product, thus avoiding engagement with the relatively weaker portions of the product away from the corners thereof while at the same time properly positioning and stabilizing the post 52 with the intermediate portion of the inner wall in direct contact with the product corner.

FIG. 7 illustrates a corner post 70 which is a variation of the corner post 52 of FIG. 6 and similarly includes internally folding beads 72 and 74 respectively defined from the inner wall 76 and outer wall 78. The inner wall beads 72, one in each of the angled post sections, engages an opposed bead 80 defined in the outer wall 78. Each bead 80 is formed in the manner of the beads normally occurring in the prior art posts. Basically, the side panels 82 of the bead 80 converge inwardly from the corresponding outer wall 78, and as such, upon the introduction of excessive compressive force, the beads 80 will merely flatten out and assume a position coplanar with the outer wall 78. The aligned inner wall bead 72, to the contrary, having a reentrant side panel 84 extending at an acute included angle 86, will fold over on itself and define the desired intermediate layers. The positioning of the beads 72 and 80 in direct opposition to each other may provide an enhanced cushioning capability while retaining all of the structural strength in the post in its two extreme positions, that is with no lateral compression and with maximum lateral compression.

The foregoing is considered illustrative of the principles of the invention. As modifications and variations will occur to those skilled in the art, it is not desired to limit the invention to the exact post constructions illustrated herein. Rather, all equivalent constructions incorporating the laterally collapsible stiffening and cushioning beads of the invention, and within the scope of the claims following hereinafter, are considered to be encompassed by the invention.

I claim:

1. A support post for a product packaging system, said post being elongate and including a first wall and a second wall substantially coextensive with said first wall, said first and second walls being laterally spaced from each other and defining a space therebetween, a bead integrally defined solely from said first wall along the length of said first wall, said bead including opposed sides, both of which extend from said first wall and toward said second wall, one of said sides extending at an acute included angle to said first wall, said walls including portions receiving said bead therebetween, said bead, under predetermined compressive loading, resisting collapse of said walls inwardly toward each other, said bead, upon compressive loading greater than said predetermined compressive loading, folding upon itself and defining multiple layers between and in addition to said walls.

2. The support post of claim 1 wherein said bead projects into free sliding engagement with said second wall.

3. The support post of claim 1 wherein said bead includes an apex portion between said sides, said apex portion freely engaging said second wall for sliding movement relative thereto upon collapse of said bead between said walls.

4. The support post of claim 1 including a bulbous portion defined by said walls to each side of said bead.

5. The support post of claim 1 wherein said first and second walls have opposed longitudinal edges with the corresponding edges of said walls being joined, said bead being laterally inwardly spaced from said edges.

6. The support post of claim 1 wherein said first and second walls are of a generally right angular cross section defining a corner post with first and second post sections extending at generally right angles to each other, said bead being defined in said first post section, and a similarly formed bead defined in said second post section, said walls having opposed longitudinal edges with the corresponding edges of said walls being joined, said beads being laterally inwardly spaced from said edges.

7. A support post for a product packaging system, said post being elongate and including a first wall and a second wall substantially coextensive with said first wall, said walls being laterally spaced from each other and defining a space therebetween, said first and second walls having common longitudinal edges integrally joined by transverse end walls, a bead integrally defined from said first wall along and substantially coextensive with the length of said first wall, at least a portion of said bead extending at an acute included angle to said first wall between said first and second walls, said first and second walls including portions receiving therebetween said portion of said bead extending at an acute included angle, said bead projecting into free sliding engagement with said second wall and, under predetermined compressive loading, resisting collapse of said first and second walls inwardly toward each other, said bead, upon compressive loading greater than said predetermined compressive loading, folding upon itself and defining multiple layers between and in addition to said first and second walls.

8. The support post of claim 7 wherein said first and second walls are of a generally right angular cross section defining a corner post with two post sections extending at generally right angles to each other, said bead being defined in one of said post sections, and a similarly formed bead defined in the second post section.

9. The support post of claim 8 including a bulbous portion defined immediately inward of each end wall and a central bulbous portion defined centrally between said beads.

10. The support post of claim 9 wherein said beads are inwardly spaced from said end walls and proximate said central bulbous portion.

11. The support post of claim 10 wherein each corner post section includes a second bead integral with and extending inward of said second wall at an angle thereto to position a portion of said second bead between overlying portions of said first and second walls.

12. The support post of claim 10 wherein said post comprises multiple plies of adhesively bonded paperboard.

13. A support post for a packaging system for products to be protected against vertical transverse compressive forces; said post being elongate and including a first wall and a second wall substantially coextensive with said first wall, said walls being laterally spaced from each other and defining a space therebetween, a bead substantially coextensive with the length of said first wall and extending transversely therefrom across said space toward said second wall, said bead including opposed sides extending from said first wall, at least one of said sides extending at an acute included angle to said first wall within said space, a second one of said sides of said bead extending at an obtuse included angle from said first wall, said bead being selectively collapsible between said walls to define multiple layers between and in addition to said walls.

14. The support post of claim 13 wherein said post is formed with a generally right angular cross section defining a corner post with two angularly related post sections, said bead being within one of said post sections, a second bead in the second post section, said second bead including opposed sides extending from one of said walls, one of said opposed sides of said second bead extending at an acute included angle to said one of said walls in said space, said second bead being collapsible between said walls to define multiple layers between and in addition to said walls.

15. The support post of claim 14 wherein said beads each include an apex portion between the sides thereof with said apex portion freely engaging the wall opposed from the wall from which the bead extends.

16. A support post for a packaging system for products to be protected against vertical transverse compressive forces; said post being elongate and including a first wall and a second wall substantially coextensive with said first wall, said walls being laterally spaced from each other and defining a space therebetween, a bead substantially coextensive with the length of said first wall and extending transversely therefrom across said space toward said second wall, said bead including opposed sides extending from said first wall, at least one of said sides extending at an acute included angle to said first wall within said space, said bead being selectively collapsible between said walls to define multiple layers between and in addition to said walls, said post being formed with a generally right angular cross section defining a corner post with two angularly related post sections, said bead being within one of said post sections, a second bead in the second post section, said second bead including opposed sides extending from one of said walls, one of said opposed sides of said second bead extending at an acute included angle to said one of said walls in said space, said second bead being collapsible between said walls to define multiple layers between and in addition to said walls, said beads each include an apex portion between the sides thereof with said apex portion freely engaging the wall opposed from the wall from which the bead extends, and bulbous portions defined between said walls to each side of each bead.

17. The support post of claim 16 wherein said walls have opposed longitudinal edges with the corresponding edges of said walls being joined by transverse end wall portions, said beads being laterally inwardly spaced from said transverse end wall portions.

18. The support post of claim 17 wherein said longitudinal edges of said walls are joined by end walls, said end walls being angled in generally the same direction as the acutely angled one side of the bead closest thereto.

* * * * *